US005791459A

United States Patent [19]

Hester et al.

[11] Patent Number: 5,791,459

[45] Date of Patent: Aug. 11, 1998

[54] NORMALLY CLOSED ELECTRICAL SWITCH

[75] Inventors: Todd A. Hester, Montgomery; Daniel T. Kreger, Aurora, both of Ill.

[73] Assignee: Molex Incorporated, Lisle, Ill.

[21] Appl. No.: 607,407

[22] Filed: Feb. 27, 1996

[51] Int. Cl.[6] ..... H01H 13/52

[52] U.S. Cl. ..... 200/512; 200/517

[58] Field of Search ..... 200/512, 517, 200/5 A

[56] References Cited

U.S. PATENT DOCUMENTS

| | | | |
|---|---|---|---|
| 4,119,821 | 10/1978 | Overton . | |
| 4,276,458 | 6/1981 | Alter . | |
| 4,289,943 | 9/1981 | Sado . | |
| 4,302,647 | 11/1981 | Kandler et al. | 200/512 |
| 4,314,117 | 2/1982 | Ditzig | 200/5 |
| 4,400,594 | 8/1983 | Serras-Paulet | 200/5 A |
| 4,618,754 | 10/1986 | Gross | 200/512 |
| 4,771,139 | 9/1988 | DeSmet | 200/5 A |
| 4,794,215 | 12/1988 | Sawada et al. . | |
| 5,015,808 | 5/1991 | Czarn et al. | 200/83 |

FOREIGN PATENT DOCUMENTS

| | | | |
|---|---|---|---|
| 1597949 | 10/1990 | U.S.S.R. | 200/512 |
| 2100517 | 12/1982 | United Kingdom | 200/512 |

*Primary Examiner*—Renee S. Luebke

*Attorney, Agent, or Firm*—Stacey E. Caldwell; James C. Paschall

[57] ABSTRACT

A normally closed electrical switch includes a first circuit board having a first switch contact thereon and an aperture therethrough near the first switch contact. A second, flexible circuit board has a second switch contact aligned with the first switch contact of the first circuit board. A spacer sheet separates the first and second circuit boards and has an aperture in registry with the aperture in the first circuit board. The switch contacts extend toward each other through the aperture in the spacer sheet such that they are in normally closed condition. A movable cover is provided on the first circuit board at least over the aperture therein. An actuator is operatively associated with the cover and extends through the aperture in the first circuit board, through the aperture in the spacer sheet and engageable with the second, flexible circuit board for flexing the second circuit board and opening the switch contacts in response to movement of the cover. At least one of the circuit boards may be embossed in the area of its respective switch contact so that the contact projects through the aperture in the spacer sheet.

19 Claims, 6 Drawing Sheets

NORMALLY CLOSED ELECTRICAL SWITCH

FIELD OF THE INVENTION

This invention generally relates to the art of electrical switches and, particularly, to a normally closed membrane-type electrical switch.

BACKGROUND OF THE INVENTION

Membrane electrical switches are used in a wide variety of applications wherein an electrical circuit is "open" or unengaged until two contacts are pressed together. Such switches often are called "touch" switches. In particular, such a switch includes a pair of non-conductive polymer film substrates or membranes, such as of plastic material, on which thin conductive contacts are screen-printed, such as of ink with conductive silver or carbon particles therein. At least one, but normally both, of the membranes are flexible. In such a normally open membrane switch, a spacer sheet is sandwiched between the pair of membranes, and the spacer sheet has an aperture aligned with the contacts. When the flexible membrane is depressed in the area of the aperture in the spacer sheet, it flexes such that its contacts engage with the contacts of other membrane to close the switch. Typically, there are conductors or leads connected to the contacts and are also printed on the flexible substrates or membranes for connecting the switch contacts to external circuits. Such normally open membrane switches are conventional and have been commercially available heretofore as low profile, inexpensive alternatives for more complex mechanical switches.

In some applications the equipment or machinery require a constant function, i.e. constant electrical contact between the contacts with an occasional or temporary interruption of the current flow. Accordingly, this type of arrangement would necessitate a "normally closed" switch wherein the contacts are in engagement until they are separated typically by an operator pushing a button. In order to make such a normally closed switch, the membranes are in close juxtaposition to maintain the contacts in mechanical and electrical engagement, and extraneous rigid support means are provided to support the normally flexible membranes. Means must also be provided for separating the membranes and their respective contacts in order to open the switch. Due to the added complexity of such switches, normally closed membrane switches often have reliability problems. Furthermore, membrane switches are not as efficient and cost effective in a normally closed configuration as in the normally open configuration described above.

As described above in regard to membrane switches, the least complex and most cost-effective membrane switches conventionally have normally open contacts. The present invention is directed to providing a membrane switch which is in a normally closed electrical condition but which still is extremely simple, reliable and cost effective.

SUMMARY OF THE INVENTION

An object, therefore, of the invention is to provide a new and improved normally closed membrane switch.

In the exemplary embodiments of the invention, the normally closed electrical switch includes a first circuit board having a first switch contact thereon and an aperture therethrough near the first switch contact. A second, flexible circuit board has a second switch contact aligned with the first switch contact of the first circuit board. A spacer separates the first and second circuit boards and has an aperture in registry with the aperture in the first circuit board. The switch contacts extend toward each other through the aperture in the spacer such that they are in normally closed condition. A movable cover is provided on the first circuit board at least over the aperture therein. Actuator means are operatively associated with the cover and extend through the aperture in the first printed circuit board, through the aperture in the spacer and are engageable with the second, flexible circuit board for flexing the second circuit board to open the switch contacts in response to movement of the cover.

As disclosed herein, the first and second circuit boards comprise non-conductive membranes or polymer film substrates, and the first and second switch contacts are conductive ink contacts screen-printed on the membranes. The spacer is generally rigid relative to the membranes. The cover is fabricated of deformable material and may include a switch button operatively associated with the actuator means. In one embodiment of the invention, the actuator means is integral with the switch button.

In the preferred embodiment, at least one of the circuit boards is embossed to project through the aperture in the spacer such that the switch contacts are in normally closed condition. In one embodiment of the invention, the actuator means is provided by a plurality of actuator posts spaced around the switch contacts. In another embodiment of the invention, the actuator means is provided by a single actuator post, and a plurality of switches are spaced around the actuator post, with each switch including one of the switch contacts on each of the circuit boards.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
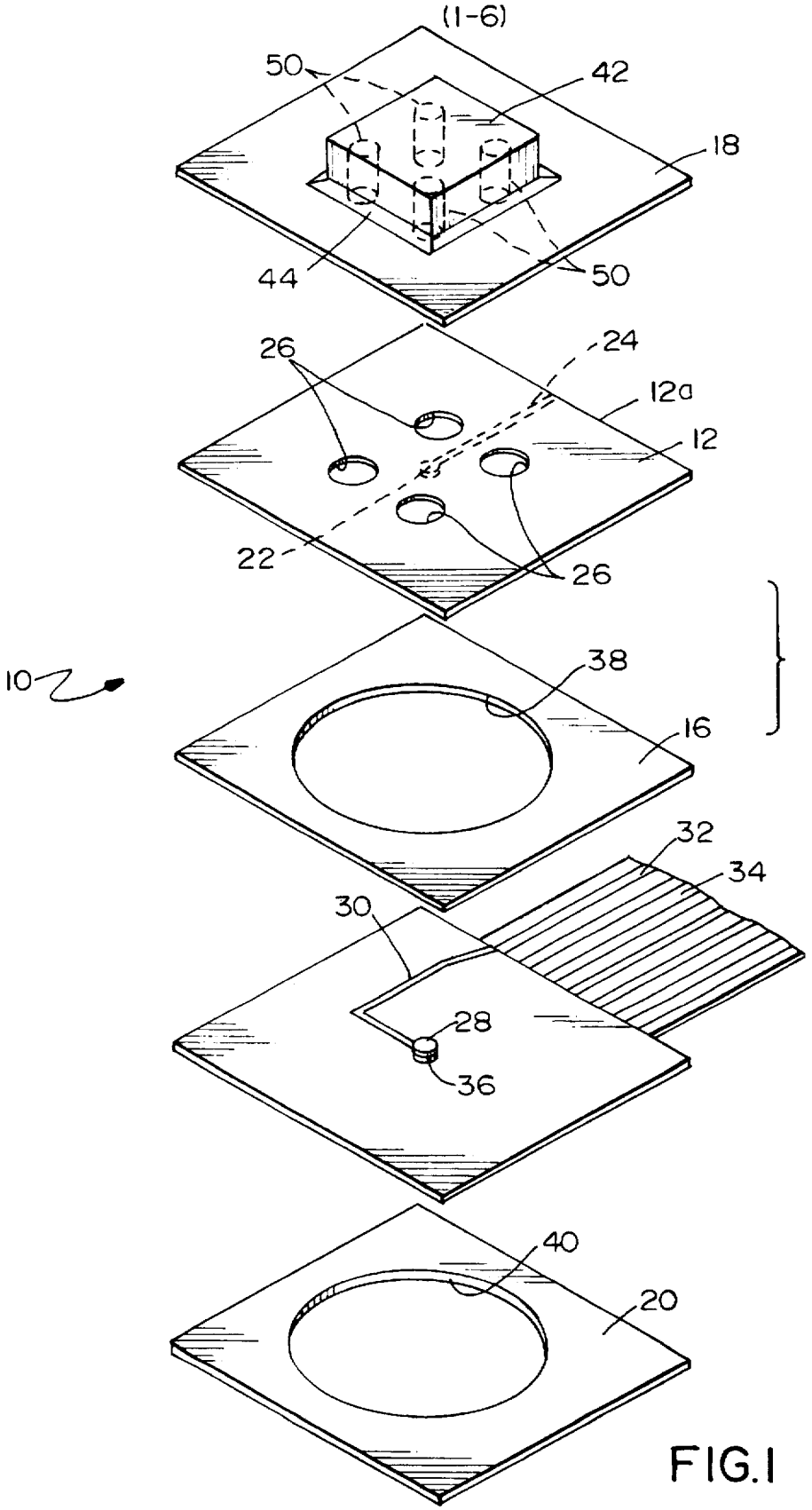
FIG. 1 is an exploded perspective view of a first embodiment of a normally closed electrical switch according to the invention.
Figure 2:
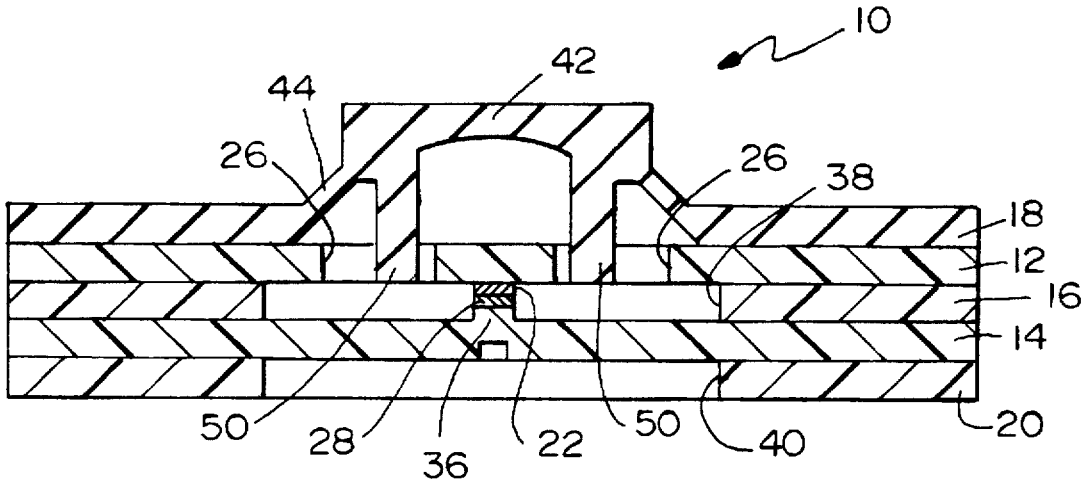
FIG. 2 is a vertical section through the first embodiment, with the switch in a normally closed condition.
Figure 3:
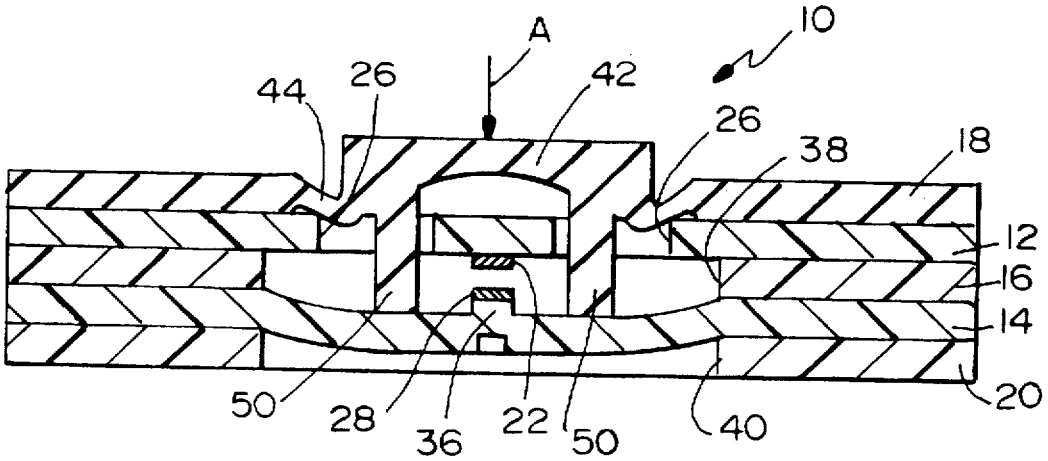
FIG. 3 is a view similar to that of FIG. 2, with the switch in an open condition.

Referring to the drawings in greater detail, and first to FIGS. 1–3, a first embodiment of a normally closed electrical switch, generally designated 10, includes a first circuit board 12 and a second circuit board 14. A spacer sheet 16 is sandwiched between circuit boards 12 and 14. A cover 18 is disposed on top of first circuit board 12, and a backing sheet 20 is disposed beneath second circuit board 14.

First circuit board 12 comprises a non-conductive polymer film membrane or substrate which is typically fabricated of a thin, flexible material having a first switch contact 22 on the underside thereof. The switch contact is provided by a conductive contact screen-printed to the surface of the membrane in the form of ink embedded with conductive silver or carbon particles. Leads 24 also screen-printed to the surface of the membrane extend from the pad to an edge 12*a* of the circuit board and connect to appropriate circuit means (not shown). A plurality of apertures 26 through circuit board 12 are equally spaced around switch contact 22.

Second circuit board 14 is fabricated of a thin flexible non-conductive membrane or film substrate having a second switch contact 28 on the top side thereof. Again, second switch contact 28 is provided by a screen-printed conductive contact having a lead 30 extending to an edge 14*a* of the circuit board, where the lead is connected to a conductor 32 of a flat electrical cable 34.

As best seen in FIGS. 2 and 3, membrane 14 is embossed, as at 36, so that second switch contact 28 projects upwardly from the top surface of the membrane of second circuit board 14. Spacer sheet 16 has an enlarged aperture 38 therethrough. The aperture is large enough to surround all of apertures 26 in first circuit board 12, with first switch contact 22 in the center thereof. The spacer sheet is fabricated of appropriate material which is generally rigid in comparison to the thin plastic membranes of first and second circuit boards 12 and 14, respectively. Therefore, the spacer sheet effectively supports the membranes.

Backing sheet 20 is similar to spacer sheet 16 in that it has an enlarged aperture 40 approximately the same size as aperture 38 in the spacer sheet. Backing sheet 20 also is generally rigid in comparison to the thin flexible membranes of circuit boards 12 and 14.

Cover 18 is fabricated of elastomeric material and includes an integral switch button 42 projecting upwardly therefrom. The switch button is integrally formed with the cover by means of a peripheral web 44 entirely surrounding the switch button. As best seen in FIGS. 2 and 3, web 44 is thinner than cover 18 and switch button 42, so that when pressure is applied to the button in the direction of arrow "A" (FIG. 3) web 44 will deform because of the elastomeric material of the integral cover/web/switch button.

Lastly, actuator means are operatively associated with cover 18, and particularly switch button 42, for flexing second circuit board 14 and opening switch contacts 22 and 28 in response to depressing switch button 42 of the cover. More particularly, as seen in FIG. 2, a plurality of actuator posts 50 are formed integral with and project inwardly or downwardly from switch button 42 through apertures 26 in first circuit board 12. These actuator posts are effective for flexing second circuit board 14 and opening normally closed switch contacts 22 and 28 as described below.

In operation of normally closed electrical switch 10, reference is made first to FIG. 2 wherein it can be seen that apertures 38 and 40 in spacer sheet 16 and backing sheet 20, respectively, are in alignment transversely through the laminated switch. In addition, it can be seen that by embossing the flexible membrane of second circuit board 14, as at 36, second switch contact 28 is elevated into engagement with first switch contact 22. In other words, embossing the membrane of the second circuit board accommodates for the thickness of spacer sheet 16.

When a force is applied to switch button 42 in the direction arrow "A" as shown in FIG. 3, web 44 between the switch button and cover 18 deforms, and actuator posts 50 are driven downwardly through apertures 26 in first circuit board 12, through aperture 38 in spacer sheet 16 and against the top surface of second circuit board 14. This pressure or force flexes the membrane of second circuit board 14 into aperture 40 of backing sheet 20 and, thereby, separates or opens switch contacts 22 and 28. In essence, actuator posts 50 move switch contact 28 away from switch contact 22.

The various laminates including cover 18, first circuit board 12, spacer sheet 16, second circuit board 14 and backing sheet 20 are held together as a laminate by appropriate adhesive. In fact, it should be understood that backing sheet 20 could be eliminated, with second circuit board 14 fixed to the more rigid spacer sheet 16 by an appropriate adhesive. Provided that nothing obstructs the flexing of the second circuit board 14, such an arrangement would still allow the second circuit board to be moved away from the first circuit board to open the switch contacts, by depressing switch button 42 and driving actuator posts 50 against the top of the flexible second circuit board.

Figure 4:
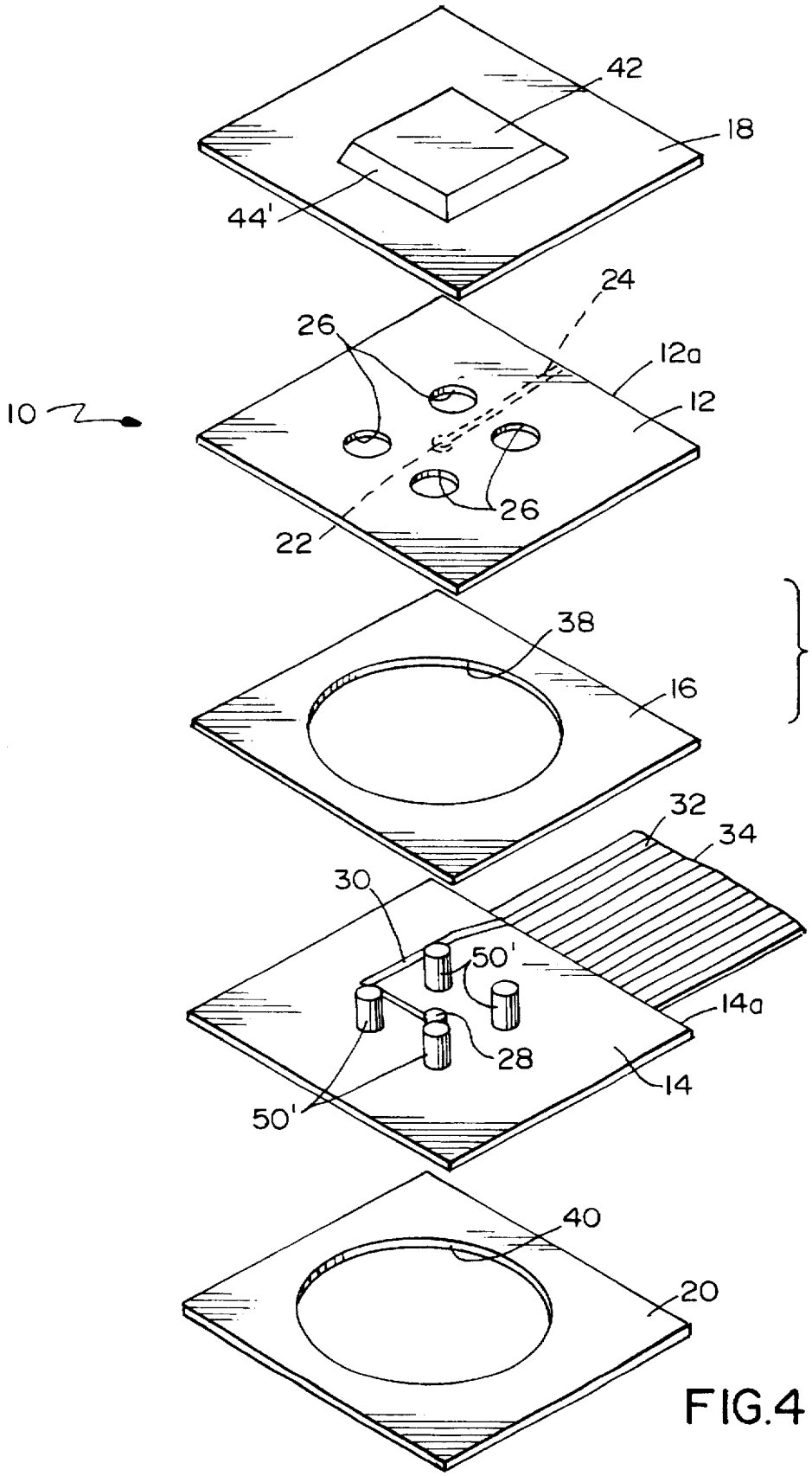
FIGS. 4–6 are views similar to that of FIGS. 1–3, respectively, of a second embodiment of the invention.
Figure 5:
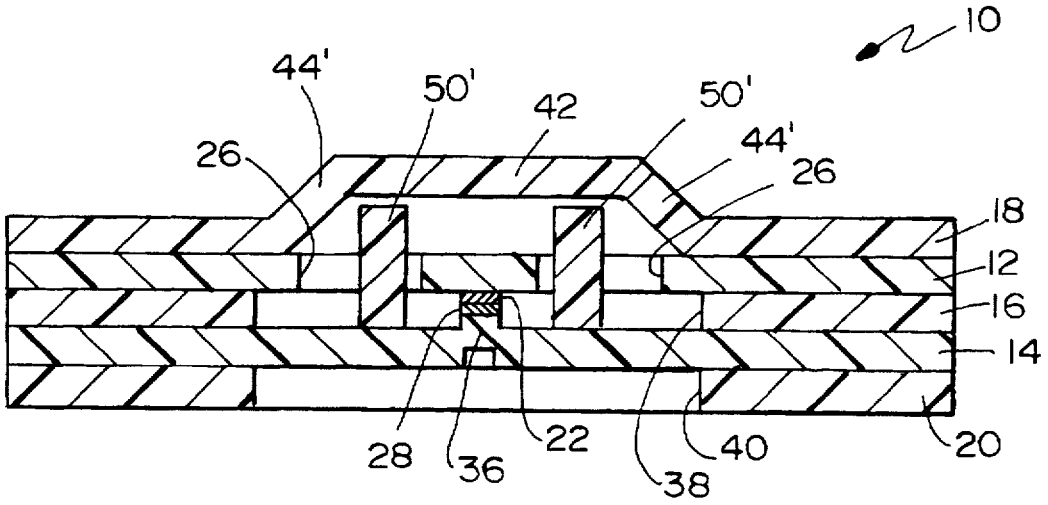
Figure 6:
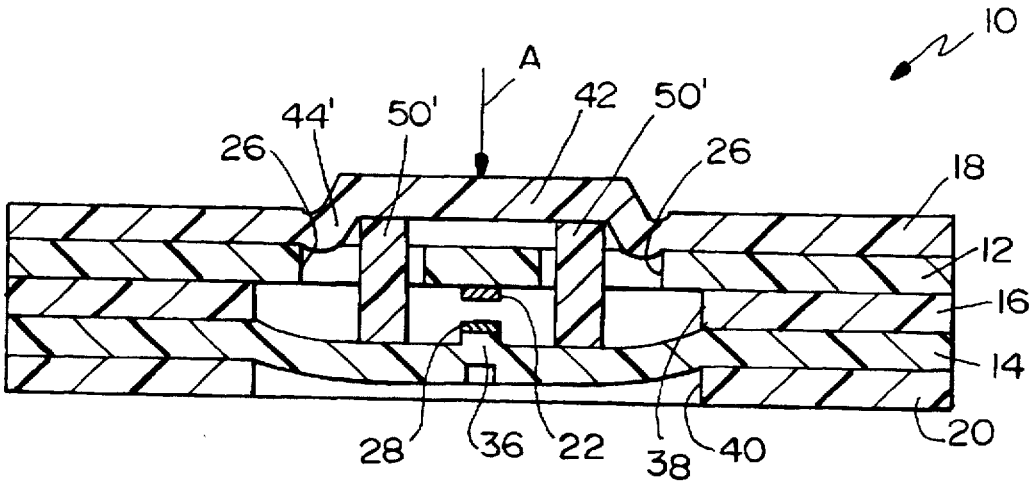

The second embodiment of the normally closed electrical switch shown in FIGS. 4–6 operates substantially the same as the first embodiment described above and shown in FIGS. 1–3. Therefore, like numerals have been applied where appropriate in FIGS. 4–6 to designate like components described above in relation to FIGS. 1–3. However, there are two primary differences from the first embodiment in the second embodiment of FIGS. 4–6.

The first difference is that switch button 42 is joined to cover 18 by means of an oblique or angled web 44' as best seen in FIG. 5. This angled web acts as a camming surface should the switch be used in applications wherein an item, such as a beverage can, might roll over the switch button in order to open the switch.

The second difference in the second embodiment of FIGS. 4–6 is seen best in FIGS. 4 and 5 wherein actuator posts 50' project upwardly from second circuit board 14 rather than downwardly from the underside of switch button 42. In manufacture, the actuator posts 50' would be made as separate components appropriately adhered to the top of second circuit board 14 rather than being integral with the underside of switch button 42 as in the first embodiment of FIGS. 1–3. By not having the actuator posts as integral portions of the cover and/or switch button, the cover and switch button, along with angled web 44', can be simply and inexpensively fabricated of a uniform thickness of material. Of course, it can be appreciated that these two differences are independent of one another. Thus, for example, the angled web of FIGS. 4–6 may be combined with the downwardly projecting posts of FIGS. 1–3, while the more upright web of FIGS. 1–3 may be utilized with the upwardly projecting posts of FIGS. 4–6.

Figure 7:
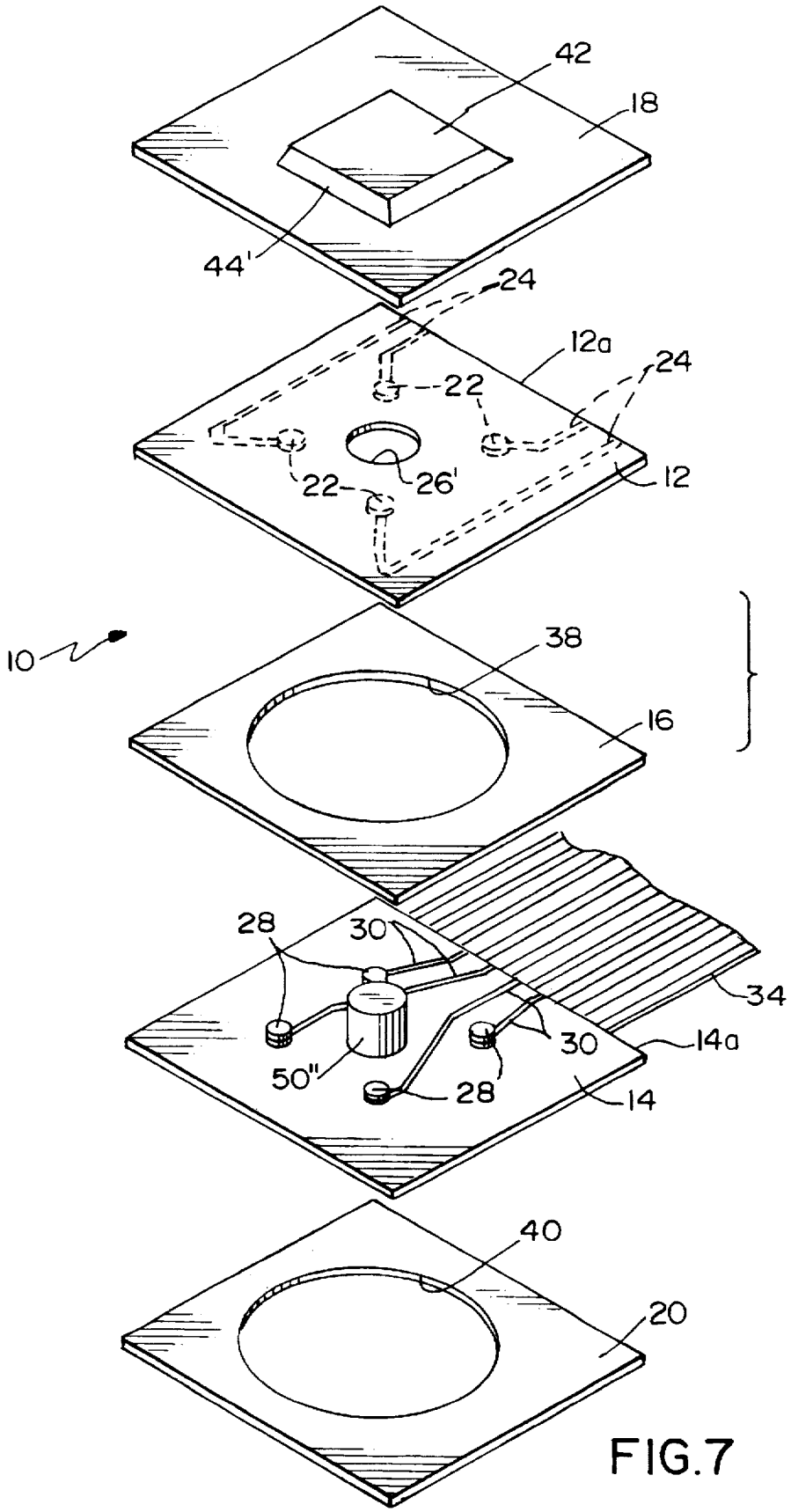
FIGS. 7–9 are views similar to that of FIGS. 1–3, respectively, but of a third embodiment of the invention.
Figure 8:
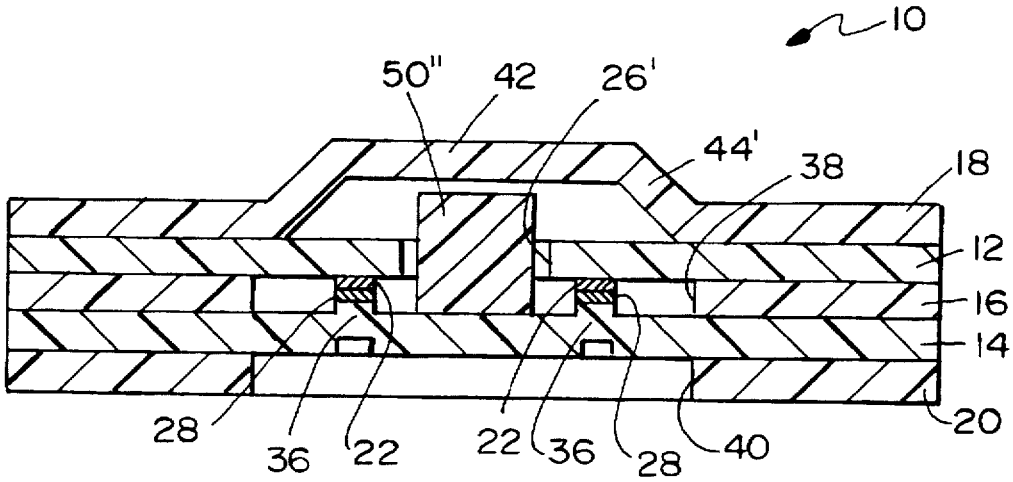
Figure 9:
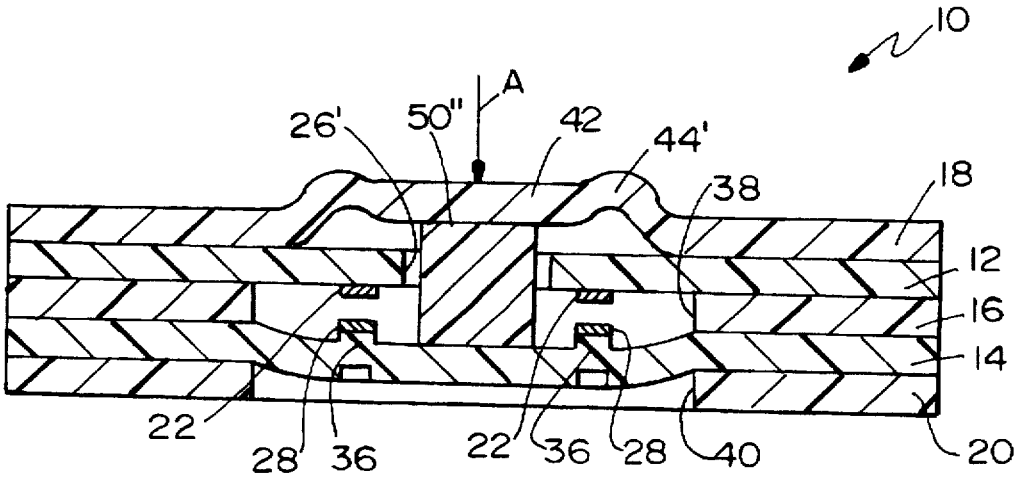

FIGS. 7–9 show a third embodiment of the normally closed electrical switch and, again, like numerals have been applied in FIGS. 7–9 to designate like components described above and shown in FIGS. 1–6. More particularly, the third embodiment of FIGS. 7–9 is similar to the second embodiment of FIGS. 4–6, in that switch button 42 is joined to cover 18 by an angled web 44', with the cover, web and button being fabricated of a material of uniform thickness.

In addition, rather than having a plurality of separate actuator posts 50' as in the second embodiment of FIGS. 4–6, the third embodiment of FIGS. 7–9 employs a single, center actuator post 50". The post projects through a single aperture 26' in first circuit board 12.

The third embodiment of FIGS. 7–9 also employs a plurality of pairs of normally closed switch contacts 22 and 28 surrounding the single actuator post 50". The flexible plastic membrane of second circuit board 14 again is embossed, as at 36, so that switch contacts 28 project upwardly through aperture 38 in spacer sheet 16 to normally engage switch contacts 22, and, thereby, compensate for the thickness of the spacer sheet. Again, as best shown in FIG. 8, the single actuator post 50" is preferably adhered to the top of second circuit board 14, but alternatively may be arranged to descend from switch button 42 (not shown).

Finally, although first and second circuit boards 12 and 14, respectively, along with spacer sheet 16, cover 18 and backing sheet 20 all are shown herein as being square sheets or portions of a laminated composite structure, it should be understood that these sheets may comprise only portions of much larger sheet-like components. In other words, first and second circuit boards 12 and 14, respectively, may be only portions of much larger circuit boards.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A normally closed electrical switch, comprising:

a first circuit board having a first switch contact thereon and a first aperture therethrough near the first switch contact;

a second, flexible circuit board having a second switch contact aligned with the first switch contact of the first circuit board;

a spacer separating the first and second circuit boards and having a second aperture in operative alignment with said first aperture in the first circuit board;

said switch contacts extending toward each other through said second aperture in the spacer such that they are in normally closed condition;

a movable cover on the first circuit board at least over said first aperture therein; and an actuator operatively associated with the cover and extending through said first aperture in the first circuit board, through said second aperture in the spacer and operatively associated with the second, flexible circuit board for flexing the second circuit board and opening the switch contacts in response to movement of the cover.

2. The normally closed electrical switch of claim 1 wherein said second, flexible circuit board comprises a non-conductive membrane, and said second switch contact comprises a conductive ink contact screen-printed on the membrane.

3. The normally closed electrical switch of claim 2 wherein said first circuit board comprises a non-conductive membrane, and said first switch contact comprises a conductive ink contact screen-printed on the membrane.

4. The normally closed electrical switch of claim 3 wherein said spacer is generally rigid relative to at least one of said plastic membranes.

5. The normally closed electrical switch of claim 1 wherein said cover is fabricated of deformable material.

6. The normally closed electrical switch of claim 1 wherein said actuator is integral with said cover.

7. The normally closed electrical switch of claim 1 wherein said actuator includes at least one actuator post mounted on the second circuit board.

8. The normally closed electrical switch of claim 1 wherein at least one of said circuit boards is embossed to project at least partly through said second aperture in the spacer such that the switch contacts are in normally closed condition.

9. The normally closed electrical switch of claim 1 wherein said cover includes a movable switch button operatively associated with said actuator.

10. The normally closed electrical switch of claim 1 wherein the first circuit board has a plurality of apertures, including said first aperture, therethrough spaced around the switch contacts, and wherein said actuator comprises a plurality of actuator posts, each actuator post extending through one of said plurality of apertures.

11. The normally closed electrical switch of claim 1 wherein said actuator comprises a single actuator post, and including a plurality of switches spaced around the actuator post, each switch including one of said first switch contacts and one of said second switch contacts.

12. A normally closed electrical switch, comprising:

a first circuit board having a first switch contact thereon and an aperture therethrough near the first switch contact, the first circuit board including a thin non-conductive membrane having a conductive contact thereon defining said first switch contact;

a second, flexible circuit board having a second switch contact aligned with the first switch contact of the first circuit board, the second circuit board including a thin non-conductive membrane having a conductive contact defining said second switch contact;

a spacer sheet sandwiched between the membranes of the first and second circuit boards, the spacer sheet being generally rigid relative to the membranes and having an aperture in operative alignment with the aperture in the first circuit board;

at least one of said circuit boards being embossed in the area of its respective switch contact to project at least partly through the aperture in the spacer sheet such that the switch contacts are in normally closed condition;

a movable cover on the first circuit board at least over the aperture therein; and an actuator operatively associated with the cover and extending through the aperture in the first circuit board, through the aperture in the spacer sheet and operatively associated with the second, flexible circuit board for flexing the second circuit board and opening the switch contacts in response to movement of the cover.

13. The normally closed electrical switch of claim 12 wherein said cover is fabricated of deformable material.

14. The normally closed electrical switch of claim 12 wherein said actuator is integral with said cover.

15. The normally closed electrical switch of claim 12 wherein said actuator includes at least one actuator post mounted on the second circuit board.

16. The normally closed electrical switch of claim 12 wherein said cover includes a movable switch button operatively associated with said actuator.

17. The normally closed electrical switch of claim 12 wherein the first circuit board has a plurality of apertures therethrough spaced around the switch contacts, and wherein said actuator comprises a plurality of actuator posts, each actuator post extending through one of said plurality of apertures.

18. The normally closed electrical switch of claim 12 wherein said actuator comprises a single actuator post, and including a plurality of switches spaced around the actuator asset, each switch including one of said first switch contacts and one of said second switch contacts.

19. The normally closed electrical switch of claim 12, including a backing sheet on the outside of said second circuit board, the backing sheet having an aperture in operative alignment with the aperture in the spacer sheet.

* * * * *